US009856866B2

(12) United States Patent
Moore et al.

(10) Patent No.: US 9,856,866 B2
(45) Date of Patent: Jan. 2, 2018

(54) OIL-FREE AIR COMPRESSOR FOR RAIL VEHICLES

(75) Inventors: Roland S. Moore, Greer, SC (US); Michael V. Kazakis, Roebuck, SC (US); Antione T. Ford, Greenville, SC (US); Murtaza R. Dossaji, Spartanburg, SC (US)

(73) Assignee: Wabtec Holding Corp., Wilmerding, PA (US)

( * ) Notice: Subject to any disclaimer, the term of this patent is extended or adjusted under 35 U.S.C. 154(b) by 613 days.

(21) Appl. No.: 13/350,980

(22) Filed: Jan. 16, 2012

(65) Prior Publication Data

US 2012/0192710 A1 Aug. 2, 2012

Related U.S. Application Data

(60) Provisional application No. 61/437,333, filed on Jan. 28, 2011.

(51) Int. Cl.

| | |
|---|---|
| ***F04B 39/12*** | (2006.01) |
| ***F04B 39/00*** | (2006.01) |
| ***F04B 25/00*** | (2006.01) |
| ***F04B 11/00*** | (2006.01) |
| ***F04B 27/00*** | (2006.01) |
| *F04B 27/02* | (2006.01) |

(52) U.S. Cl.

CPC ..... *F04B 39/0094* (2013.01); *F04B 11/0091* (2013.01); *F04B 25/005* (2013.01); *F04B 27/005* (2013.01); *F04B 39/121* (2013.01); *F04B 27/02* (2013.01)

(58) Field of Classification Search

CPC . F16J 1/16; F04B 39/121; F04B 39/14; F04B 39/0094; F16C 3/10; F16C 3/12; F16C 3/14

USPC ..... 92/187, 150; 417/534

See application file for complete search history.

(56) References Cited

U.S. PATENT DOCUMENTS

| | | | |
|---|---|---|---|
| 1,613,835 | A | 1/1927 | Kasper |
| 1,780,398 | A | 11/1930 | Morgan et al. |

(Continued)

FOREIGN PATENT DOCUMENTS

| | | |
|---|---|---|
| BE | 1017067 A3 | 8/2008 |
| CH | 415929 | 11/1963 |

(Continued)

*Primary Examiner* — Logan Kraft
*Assistant Examiner* — Abiy Teka
(74) *Attorney, Agent, or Firm* — The Webb Law Firm

(57) ABSTRACT

An oil-free compressor for a rail vehicle includes a multi-piece compressor housing, a first piston cylinder supported in a first opening in the compressor housing, a second piston cylinder supported in a second opening in the compressor housing, and a multi-piece crankshaft assembly supported by the compressor housing. The crankshaft assembly is linked to pistons of the first and second piston cylinders by respective connecting rods. The connecting rods connect to a wrist pin associated with each of the pistons, and the wrist pins are respectively supported by a dry lubricant bushing to the associated piston. The compressor housing may have at least a first housing portion and a second housing portion. The first housing portion and the second housing portion may form respective halves of the compressor housing that are secured together with mechanical fasteners.

20 Claims, 13 Drawing Sheets

(56) References Cited

U.S. PATENT DOCUMENTS 1,821,612 A 9/1931 Buchli
1,972,750 A 9/1934 Aikman
2,053,593 A 9/1936 Ziska et al.
2,628,015 A 2/1953 Neugebauer et al.
2,747,428 A 5/1956 Peter et al.
2,881,973 A 4/1959 Ricardo
3,130,901 A 4/1964 Alfieri
3,134,334 A * 5/1964 Smith ..... 418/26
3,181,779 A 5/1965 Rhodes
3,204,864 A 9/1965 Malaker et al.
3,233,554 A 2/1966 Huber et al.
3,272,092 A 9/1966 Vielmo et al.
3,300,997 A 1/1967 Kocher
3,358,914 A 12/1967 Macmillan
3,415,237 A 12/1968 Harkness
3,494,261 A 2/1970 Moore
3,548,721 A 12/1970 Eisenmegger
3,587,406 A 6/1971 Gannaway et al.
3,698,838 A 10/1972 Holdsworth et al.
3,753,629 A 8/1973 Jackson
3,759,058 A 9/1973 Jacobs
3,768,236 A 10/1973 Rudge
3,768,263 A 10/1973 Olson et al.
3,779,672 A 12/1973 Schroeder
3,784,333 A 1/1974 Whelan
3,796,025 A 3/1974 Kasten
3,839,946 A 10/1974 Paget
3,844,688 A 10/1974 Bulkley et al.
3,870,910 A 3/1975 Fussner
3,885,460 A 5/1975 Park
3,961,868 A 6/1976 Droege, Sr. et al.
3,961,869 A 6/1976 Droege, Sr. et al.
3,983,788 A 10/1976 Andersson et al.
3,994,630 A 11/1976 Rodgers
4,015,915 A 4/1977 Hardman
4,023,467 A 5/1977 Thurner
4,025,124 A 5/1977 Fuchs
4,026,252 A * 5/1977 Wrin ..... F01B 1/062 123/197.1
4,068,727 A 1/1978 Andersson et al.
4,102,608 A 7/1978 Balkau et al.
4,190,402 A 2/1980 Meece et al.
4,264,282 A 4/1981 Crago
4,286,976 A 9/1981 Eriksson
4,316,705 A 2/1982 Siewert
4,350,475 A 9/1982 Meece et al.
4,474,541 A 10/1984 Siewert
4,529,365 A 7/1985 Schutt et al.
4,611,503 A * 9/1986 Kocher ..... F02F 7/0053 123/192.2
4,729,291 A 3/1988 Miller
4,756,674 A 7/1988 Miller
4,929,161 A 5/1990 Aoki et al.
4,974,554 A * 12/1990 Emery ..... 123/48 B
5,007,331 A 4/1991 Greiner et al.
5,039,281 A 8/1991 Johnston
5,088,284 A 2/1992 Momose
5,137,434 A 8/1992 Wheeler et al.
5,152,677 A 10/1992 Bauer et al.
5,169,162 A 12/1992 Azaml et al.
5,195,420 A 3/1993 Wanner
5,249,506 A 10/1993 Willimczik
5,287,916 A 2/1994 Miller
5,347,915 A 9/1994 Feistel
5,419,688 A 5/1995 Basinski et al.
5,435,059 A * 7/1995 Chawla ..... 29/888.08
5,447,422 A 9/1995 Aoki et al.
5,483,992 A 1/1996 Lehmann
5,515,769 A 5/1996 Basinski et al.
5,562,170 A 10/1996 Wolfer et al.
5,584,675 A 12/1996 Steurer et al.
5,597,294 A 1/1997 McGrath
5,681,372 A 10/1997 Magits
5,711,205 A 1/1998 Wolfer et al.
5,711,206 A 1/1998 Goettel
5,755,561 A 5/1998 Couillard et al.
5,826,491 A 10/1998 Steiger
5,850,777 A 12/1998 Marklin et al.
5,862,891 A 1/1999 Kroger et al.
5,871,337 A 2/1999 Fukanuma et al.
5,873,708 A 2/1999 Delhomme, II et al.
5,879,145 A 3/1999 Baumgartner
5,957,667 A 9/1999 Epp
6,041,897 A 3/2000 Saumweber et al.
6,056,521 A 5/2000 Leu et al.
6,059,552 A * 5/2000 Martensen et al. ..... 418/182
6,062,833 A 5/2000 Holzapfel et al.
6,071,098 A 6/2000 Richards
6,113,367 A 9/2000 Dunaevsky et al.
6,136,076 A 10/2000 Read
6,183,211 B1 2/2001 Wood
6,193,482 B1 2/2001 Chen
6,202,537 B1 3/2001 Havran
6,210,132 B1 4/2001 Shiinoki et al.
6,213,000 B1 4/2001 Wood
6,247,901 B1 6/2001 Unger
6,293,764 B1 9/2001 Baumann
6,318,502 B1 11/2001 Unger
6,322,332 B1 11/2001 Jensen et al.
6,364,632 B1 4/2002 Cromm et al.
6,457,722 B1 10/2002 Feistel
6,485,266 B2 11/2002 DeRuyter
6,530,760 B1 3/2003 Graber et al.
6,558,135 B1 5/2003 Wood
6,599,103 B2 7/2003 Finnamore et al.
6,609,899 B1 8/2003 Finnamore
6,644,263 B2 11/2003 Hare
6,645,277 B1 11/2003 Franz et al.
6,648,612 B2 11/2003 Hsiao
6,684,755 B2 2/2004 Boyd et al.
6,688,859 B2 2/2004 Graber et al.
6,692,236 B1 2/2004 Filippo et al.
6,776,587 B2 8/2004 Meyer et al.
6,817,495 B1 11/2004 Luck
6,884,043 B2 4/2005 Kimberlin et al.
6,890,158 B2 5/2005 Graber et al.
6,905,315 B2 6/2005 Graber et al.
6,948,915 B2 9/2005 Nishimura
6,973,868 B2 12/2005 Schneider et al.
7,037,090 B2 5/2006 Leu
7,059,841 B2 6/2006 Hartl et al.
7,140,291 B2 11/2006 Dunaevsky et al.
7,185,582 B2 3/2007 Inoue et al.
7,240,647 B2 7/2007 Betzmeir
7,455,506 B2 11/2008 Dunaevsky
7,610,847 B2 11/2009 McKelroy
7,757,599 B2 7/2010 Adolfsson
8,062,003 B2 11/2011 Goertzen et al.
8,113,799 B2 2/2012 Wu et al.
8,167,584 B2 5/2012 Pyke et al.
8,434,306 B2 5/2013 Robinson
8,662,863 B2 3/2014 Speir
2002/0062657 A1* 5/2002 Dittrich ..... 62/296
2002/0079764 A1 6/2002 Cook
2003/0006562 A1 1/2003 Feistel
2003/0024384 A1 2/2003 Dunaevsky et al.
2003/0030223 A1 2/2003 Rinaldo
2003/0086793 A1 5/2003 Matt et al.
2003/0108435 A1* 6/2003 Meyer ..... F04B 25/00 417/255
2003/0180161 A1 9/2003 Hsiao
2004/0028538 A1 2/2004 Hartl et al.
2004/0089147 A1 5/2004 Schneider et al.
2004/0103644 A1 6/2004 Sabelstrom et al.
2004/0151964 A1 8/2004 Finger et al.
2004/0170517 A1 9/2004 Kawata et al.
2004/0175280 A1 9/2004 Seo
2004/0253122 A1 12/2004 Grochowski
2005/0188839 A1 9/2005 Inoue
2006/0013698 A1 1/2006 Pervaiz et al.
2006/0045768 A1 3/2006 Chuang
2006/0045770 A1 3/2006 Chuang
2006/0147800 A1 7/2006 Sato et al.
2006/0150747 A1 7/2006 Mallett

(56) References Cited

U.S. PATENT DOCUMENTS

| | | | |
|---|---|---|---|
| 2006/0169134 | A1 | 8/2006 | Dunaevsky et al. |
| 2006/0181173 | A1 | 8/2006 | Takahashi et al. |
| 2006/0222520 | A1 | 10/2006 | Goodell |
| 2006/0254418 | A1 | 11/2006 | Barbezat |
| 2006/0266030 | A1* | 11/2006 | Solomon et al. ..... 60/508 |
| 2007/0065301 | A1* | 3/2007 | Goertzen et al. ..... 417/273 |
| 2007/0148016 | A1 | 6/2007 | Crawford, Jr. et al. |
| 2007/0160484 | A1 | 7/2007 | Inoue |
| 2007/0193443 | A1 | 8/2007 | Adolfsson |
| 2007/0264135 | A1 | 11/2007 | Hartl et al. |
| 2007/0292289 | A1 | 12/2007 | Hartl |
| 2008/0034783 | A1 | 2/2008 | Hinrichs et al. |
| 2008/0034784 | A1 | 2/2008 | Schillemeit et al. |
| 2008/0152519 | A1 | 6/2008 | Chern |
| 2008/0168898 | A1 | 7/2008 | Hardin et al. |
| 2008/0213115 | A1 | 9/2008 | Hilger et al. |
| 2008/0242966 | A1 | 10/2008 | Sagehashi |
| 2008/0264918 | A1 | 10/2008 | Helf et al. |
| 2008/0289488 | A1 | 11/2008 | Raffaele et al. |
| 2009/0016908 | A1 | 1/2009 | Hartl |
| 2009/0068040 | A1 | 3/2009 | Mann et al. |
| 2009/0074567 | A1 | 3/2009 | Seagrave |
| 2009/0214361 | A1 | 8/2009 | Voicu et al. |
| 2009/0217902 | A1 | 9/2009 | Hartl |
| 2009/0220359 | A1 | 9/2009 | Koeck et al. |
| 2009/0220364 | A1 | 9/2009 | Rigal et al. |
| 2009/0232686 | A1 | 9/2009 | Ay et al. |
| 2009/0257902 | A1 | 10/2009 | Ernens |
| 2009/0324430 | A1 | 12/2009 | Pyke et al. |
| 2010/0034670 | A1 | 2/2010 | Smith |
| 2010/0054958 | A1 | 3/2010 | Hartl et al. |
| 2010/0135840 | A1 | 6/2010 | Fujimoto et al. |
| 2010/0158712 | A1 | 6/2010 | Hartl et al. |
| 2010/0221128 | A1 | 9/2010 | Mellar et al. |
| 2010/0290930 | A1 | 11/2010 | Arvidsson |
| 2011/0277625 | A1 | 11/2011 | Diekmeyer et al. |
| 2011/0277626 | A1 | 11/2011 | Asai |
| 2012/0192710 | A1 | 8/2012 | Moore et al. |

FOREIGN PATENT DOCUMENTS

| | | | |
|---|---|---|---|
| CN | 2227585 | Y | 5/1996 |
| CN | 2273784 | Y | 2/1998 |
| CN | 2363079 | Y | 2/2000 |
| CN | 2369007 | Y | 3/2000 |
| CN | 2376548 | Y | 5/2000 |
| CN | 2417308 | Y | 1/2001 |
| CN | 2436680 | Y | 6/2001 |
| CN | 2480585 | Y | 3/2002 |
| CN | 2482592 | Y | 3/2002 |
| CN | 2490329 | Y | 5/2002 |
| CN | 2532269 | Y | 1/2003 |
| CN | 2567362 | Y | 8/2003 |
| CN | 2613617 | Y | 4/2004 |
| CN | 2643024 | Y | 9/2004 |
| CN | 2716544 | Y | 8/2005 |
| CN | 2716545 | Y | 8/2005 |
| CN | 2748708 | Y | 12/2005 |
| CN | 1756053 | A | 4/2006 |
| CN | 2777246 | Y | 5/2006 |
| CN | 2784613 | Y | 5/2006 |
| CN | 2799896 | Y | 7/2006 |
| CN | 2826001 | Y | 10/2006 |
| CN | 2854132 | Y | 1/2007 |
| CN | 2893215 | Y | 4/2007 |
| CN | 2908850 | Y | 6/2007 |
| CN | 2908853 | Y | 6/2007 |
| CN | 2913671 | Y | 6/2007 |
| CN | 2924068 | Y | 7/2007 |
| CN | 201003492 | Y | 1/2008 |
| CN | 101153584 | A | 4/2008 |
| CN | 201096071 | Y | 8/2008 |
| CN | 201209545 | Y | 3/2009 |
| CN | 201236792 | Y | 5/2009 |
| CN | 101482105 | A | 7/2009 |
| CN | 201277161 | Y | 7/2009 |
| CN | 101571116 | A | 11/2009 |
| CN | 101571117 | A | 11/2009 |
| CN | 201344108 | Y | 11/2009 |
| CN | 101614200 | A | 12/2009 |
| CN | 201368004 | Y | 12/2009 |
| CN | 201381981 | Y | 1/2010 |
| CN | 201412300 | Y | 2/2010 |
| CN | 201412302 | Y | 2/2010 |
| CN | 201437759 | Y | 4/2010 |
| CN | 101737319 | A | 6/2010 |
| CN | 201507422 | U | 6/2010 |
| CN | 201507452 | U | 6/2010 |
| CN | 101768822 | A | 7/2010 |
| CN | 101776052 | A | 7/2010 |
| CN | 101776057 | A | 7/2010 |
| CN | 201546926 | U | 8/2010 |
| CN | 201560910 | U | 8/2010 |
| CN | 201593495 | U | 9/2010 |
| CN | 201650663 | U | 11/2010 |
| CN | 201650668 | U | 11/2010 |
| CN | 201650675 | U | 11/2010 |
| CN | 201705618 | U | 1/2011 |
| CN | 201705619 | U | 1/2011 |
| CN | 201747561 | U | 2/2011 |
| CN | 201802575 | U | 4/2011 |
| CN | 102094785 | A | 6/2011 |
| CN | 201851310 | U | 6/2011 |
| CN | 201865877 | U | 6/2011 |
| CN | 202012466 | U | 10/2011 |
| CN | 102230460 | A | 11/2011 |
| CN | 202082084 | U | 12/2011 |
| DE | 1088182 | | 9/1960 |
| DE | 1133856 | | 7/1962 |
| DE | 1600479 | | 5/1970 |
| DE | 1628146 | | 7/1971 |
| DE | 2656508 | A1 | 6/1978 |
| DE | 8514667 | U1 | 6/1985 |
| DE | 3720462 | A1 | 12/1988 |
| DE | 4006156 | A1 | 8/1991 |
| DE | 4015637 | A1 | 11/1991 |
| DE | 29604514 | U1 | 3/1997 |
| DE | 19650033 | A1 | 6/1998 |
| DE | 10138070 | A1 | 2/2003 |
| DE | 10308430 | A1 | 9/2004 |
| DE | 102006018183 | A1 | 10/2007 |
| DE | 202006011229 | U1 | 10/2007 |
| EP | 0162833 | A1 | 11/1985 |
| EP | 0221637 | A2 | 11/1986 |
| EP | 0314133 | A2 | 10/1988 |
| EP | 0503139 | A2 | 9/1992 |
| EP | 0721066 | A2 | 7/1996 |
| FR | 1463769 | | 12/1966 |
| GB | 240593 | | 10/1925 |
| GB | 465017 | | 4/1937 |
| GB | 958541 | | 5/1964 |
| GB | 1222609 | | 2/1971 |
| GB | 1373438 | | 11/1974 |
| GB | 1427707 | | 3/1976 |
| GB | 1446851 | | 8/1976 |
| GB | 1482450 | | 8/1977 |
| GB | 2047158 | A | 11/1980 |
| GB | 2068765 | A | 8/1981 |
| JP | 6246706 | B2 | 10/1987 |
| JP | 10061551 | A | 3/1998 |
| JP | 11082741 | A | 3/1999 |
| JP | 2000145962 | | 5/2000 |
| JP | 2002161883 | A | 6/2002 |
| JP | 2002202057 | A | 7/2002 |
| JP | 2002227764 | A | 8/2002 |
| JP | 2003503640 | A | 1/2003 |
| JP | 2003161250 | A | 6/2003 |
| JP | 2003519740 | A | 6/2003 |
| JP | 2004204683 | A | 7/2004 |
| JP | 2005214076 | A | 8/2005 |
| JP | 2008274840 | A | 11/2008 |
| JP | 2009506249 | A | 2/2009 |
| JP | 3150077 | | 4/2009 |
| JP | 2009250346 | A | 10/2009 |

(56) References Cited

FOREIGN PATENT DOCUMENTS

| | | | |
|---|---|---|---|
| KR | 100257679 | B1 | 7/2000 |
| KR | 20090108926 | A | 10/2009 |
| TW | 580066 | Y | 3/2004 |
| TW | 581152 | Y | 3/2004 |
| TW | 200516206 | A | 5/2005 |
| WO | 9728369 | A1 | 8/1997 |
| WO | 0218787 | A1 | 3/2002 |
| WO | 2006008400 | A1 | 1/2006 |
| WO | 2006066827 | A1 | 6/2006 |
| WO | 2011057481 | A1 | 5/2011 |
| WO | 2012000066 | A2 | 1/2012 |

* cited by examiner

OIL-FREE AIR COMPRESSOR FOR RAIL VEHICLES

CROSS REFERENCE TO RELATED APPLICATION

This application claims the benefit of U.S. Provisional Patent Application No. 61/437,333, filed Jan. 28, 2011, and entitled "Oil-Fee Air Compressor for Rail Vehicles", the disclosure of which is incorporated herein in its entirety.

BACKGROUND OF THE INVENTION

Field of the Invention

The present invention relates to the field of air compressors adapted for use on rail vehicles for the purpose of supplying compressed air to pneumatic units associated with the rail vehicle and, in particular, to an oil-free air compressor on a rail vehicle for supplying compressed air to various pneumatic units associated with the rail vehicle.

Description of Related Art

Normally, a pneumatic system is provided for a rail vehicle by which the brakes of the rail vehicle are operated. An air compressor is used to supply compressed air to one or more pneumatic units associated with the rail vehicle involved in the operation of the brakes. The air compressor usually consists of a driving unit, such as an electric motor, and of a compressor unit, which typically consists of several piston-cylinder arrangements that are driven by a crankshaft. The crankshaft is driven by the driving unit and includes connecting rods to convert the rotating movement of the driving unit into linear movement for each piston to supply compressed air to the downstream units. Screw-type air compressors are also generally known in the field for this purpose and are also included within the scope of the present invention. Furthermore, air compressor units for use on rail vehicles may have a single-stage or a multi-stage construction with at least one low-pressure stage and one high-pressure stage.

The air compressors used in the rail vehicle field may be subjected to continuous operation or to frequent on-and-off operation. In either mode of operation, friction during operation of the compressor leads to high heat development. As a result, in the past, air compressors that were predominantly used in the rail vehicle field used oil lubrication to ensure sufficient cooling during operation. However, oil lubrication carries a risk that the lubricating oil, usually situated in the housing of the compressor unit in the case of a piston air compressor, can penetrate past the piston-cylinder interface and into the pneumatic system, which may result in oil fouling the pneumatically operated brake units on the rail vehicle. Furthermore, condensate, which occurs during the required air drying of a pneumatic system, will typically contain some oil that has to be collected for environmental protection reasons. This condensate is typically stored in heatable containers and has to be drained and disposed of at regular intervals. This collection process leads to increased maintenance and disposal expenditures as well as to high oil consumption. In addition to the foregoing difficulties, emulsion formations in the oil circuit of these oil-lubricated compressor units can occur if the oil-lubricated compressor units are used infrequently or for limited periods of time as during cold weather operation.

Recently, dry-running air compressors have found increased usage in the rail vehicle field. A dry-running air compressor operates without lubricating oil situated in the housing and is said to be "oil-free". In the case of oil-free air compressors, the lubrication on the piston travel path is replaced by a particularly low-friction dynamic sealing arrangement. All rotating components are normally disposed in roller bearings. The encapsulated roller bearings are provided with a temperature-stable long-lived grease filling. In the valve area, slidably guided components are largely avoided. Because of these measures, oil lubrication is not required in the air compressor unit. The risk of fouling by oil of the compressed air can therefore also be excluded. As a result of the elimination of an oil circuit, the oil-free air compressor can have a relatively light construction. In the rail vehicle field, there is a current trend toward lighter construction, and light carrier structures are also increasingly used for frame constructions. However, such light carrier structures frequently have a number of unfavorable natural frequencies that are close to the rotational speed of the air compressor of the pneumatic system which is arranged thereon. Therefore, it is difficult to sufficiently observe the required specifications concerning permissible structure-born noise levels.

U.S. Pat. No. 6,776,587 to Hartl et al. and U.S. Pat. No. 7,059,841 to Meyer et al. are patents directed to oil-free air compressor technology. The Meyer et al. patent discloses an arrangement of an oil-free compressor apparatus on a rail vehicle for supplying compressed air to pneumatic units assigned to the rail vehicle. The arrangement includes an oil-free air compressor and a cooler unit connected with the air compressor. The arrangement also includes a rail vehicle having a floor with at least one opening. The air compressor is fastened on at least one side to the vehicle floor such that a main axis of rotation of the air compressor is arranged essentially vertical with respect to the vehicle floor. The Hartl et al. patent discloses a piston arrangement for a dual-stage piston air compressor that includes a crankshaft and several piston-cylinders. The arrangement allows two or more low-pressure stages and at least one high-pressure stage to be formed. The arrangement allows the two or more low-pressure cylinders to be arranged in relation to the high-pressure stage in such a way that said two or more low-pressure cylinders are in phase or are offset by less than a predetermined amount and compress in a position which is offset by another predetermined amount in relation to one or more of the high-pressure cylinders.

United States Patent Application Publication No. 2007/0292289 to Hartl et al. discloses a compressor piston including a piston and a cylinder, a connecting rod connecting the piston to a crankshaft in a crankcase by a roller bearing, an air inlet line, and an air outlet line in a cylinder head. A tube connection between the air inlet line and the crankcase transports cooling air from the inlet line to the crankcase. The tube connection is exterior of the cylinder. An inlet valve is connected to the tube connection which opens when the pressure in the crankcase is less than the pressure in the air inlet line, and an outlet valve is connected to the crankcase which opens when the pressure in the crankcase exceeds a predetermined value.

Further, United States Patent Application Publication No. 2009/0016908 to Hartl et al. discloses a multi-cylinder dry-running piston compressor for generating compressed air. The piston compressor includes a crankcase having an interior and a crankshaft rotatably mounted in the crankcase. Also included are two connecting rods mounted on the crankshaft and configured to run counter to one another. Further included are two cylinders mounted in the crankcase and a piston arranged at an end of each of the connecting rods and configured to run in a respective one of the two cylinders.

SUMMARY OF THE INVENTION

In one embodiment, an oil-free compressor for a rail vehicle includes a compressor housing comprising at least a first housing portion and a second housing portion, a first piston cylinder supported in a first opening in the compressor housing, a second piston cylinder supported in a second opening in the compressor housing and fluidly connected to the first piston cylinder, and a multi-piece crankshaft assembly supported by the compressor housing and linked to the pistons of the first and second piston cylinders by respective connecting rods.

The first housing portion and the second housing portion may form respective halves of the compressor housing and may be secured together with mechanical fasteners. The first piston cylinder may be larger than the second piston cylinder. The crankshaft assembly may comprise a crankshaft center section and two end sections. The end sections may contain counterweights. Opposing ends of the crankshaft center section may be secured within respective cavities in the end sections. The crankshaft center section may comprise a first arm section offset from a second arm section and each of the arm sections may define a circumferential recess for receiving a bearing associated with the respective connecting rods. The end sections may be mounted to the crankshaft center section to secure the bearings associated with the respective connecting rods.

In another embodiment, the oil-free compressor for a rail vehicle includes a multi-piece compressor housing, a first piston cylinder supported in a first opening in the compressor housing, a second piston cylinder supported in a second opening in the compressor housing and fluidly connected to the first piston cylinder, and a multi-piece crankshaft assembly supported by the compressor housing and linked to the pistons of the first and second piston cylinders by respective connecting rods. The connecting rods may connect to a wrist pin associated with each of the pistons, and the wrist pins are respectively supported by a dry lubricant bushing to the associated piston.

The compressor housing may comprise at least a first housing portion and a second housing portion. The first housing portion and the second housing portion may form respective halves of the compressor housing and may be secured together with mechanical fasteners. The first piston cylinder may be larger than the second piston cylinder. The crankshaft assembly may comprise a crankshaft center section and two end sections. The end sections may contain counterweights. Opposing ends of the crankshaft center section may be secured within respective cavities in the end sections. The crankshaft center section may comprise a first arm section offset from a second arm section and each of the arm sections may define a circumferential recess for receiving a bearing associated with the respective connecting rods. The end sections may be mounted to the crankshaft center section to secure the bearing associated with the respective connecting rods. The dry lubricant bushing may be coated with PEEK or comprise a PEEK liner.

Further details and advantages will become apparent upon reviewing the detailed description set forth herein in connection with the accompanying drawings.

DESCRIPTION OF THE PREFERRED EMBODIMENTS

Figure 1:
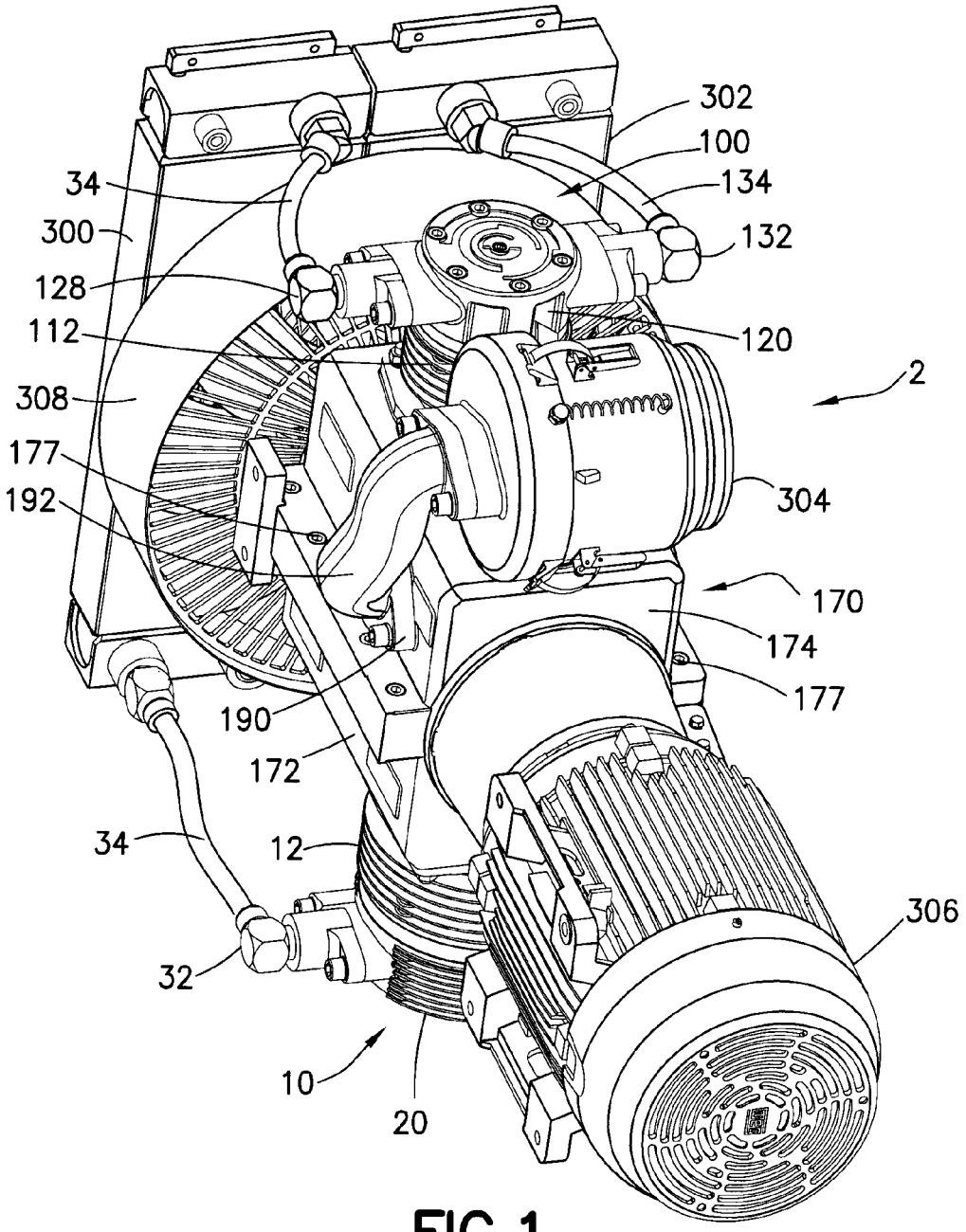
FIG. 1 is a perspective view of an oil-free air compressor for railway vehicles shown in association with a drive motor and cooling fan.

For purposes of the description hereinafter, spatial orientation terms, as used, shall relate to the referenced embodiment as it is oriented in the accompanying drawing figures or otherwise described in the following detailed description. However, it is to be understood that the embodiments described hereinafter may assume many alternative variations and configurations. It is also to be understood that the specific components, devices, and features illustrated in the accompanying drawing figures and described herein are simply exemplary and should not be considered as limiting.

Referring to FIGS. 1-6, an air compressor 2 according to one embodiment is shown. As shown, the air compressor 2 is a multi-cylinder air compressor 2 comprising at least a first piston-cylinder 10 and a second piston-cylinder 100. The respective first and second piston-cylinders 10, 100 (hereinafter referred to as "first piston cylinder 10" and "second piston cylinder 100") are supported by a compressor housing or crankcase 170 and are each driven by a crankshaft assembly 240 disposed within the compressor housing 170 and rotationally supported by the compressor housing 170. The foregoing components of the air compressor 2 are described in detail herein.

Figure 5:
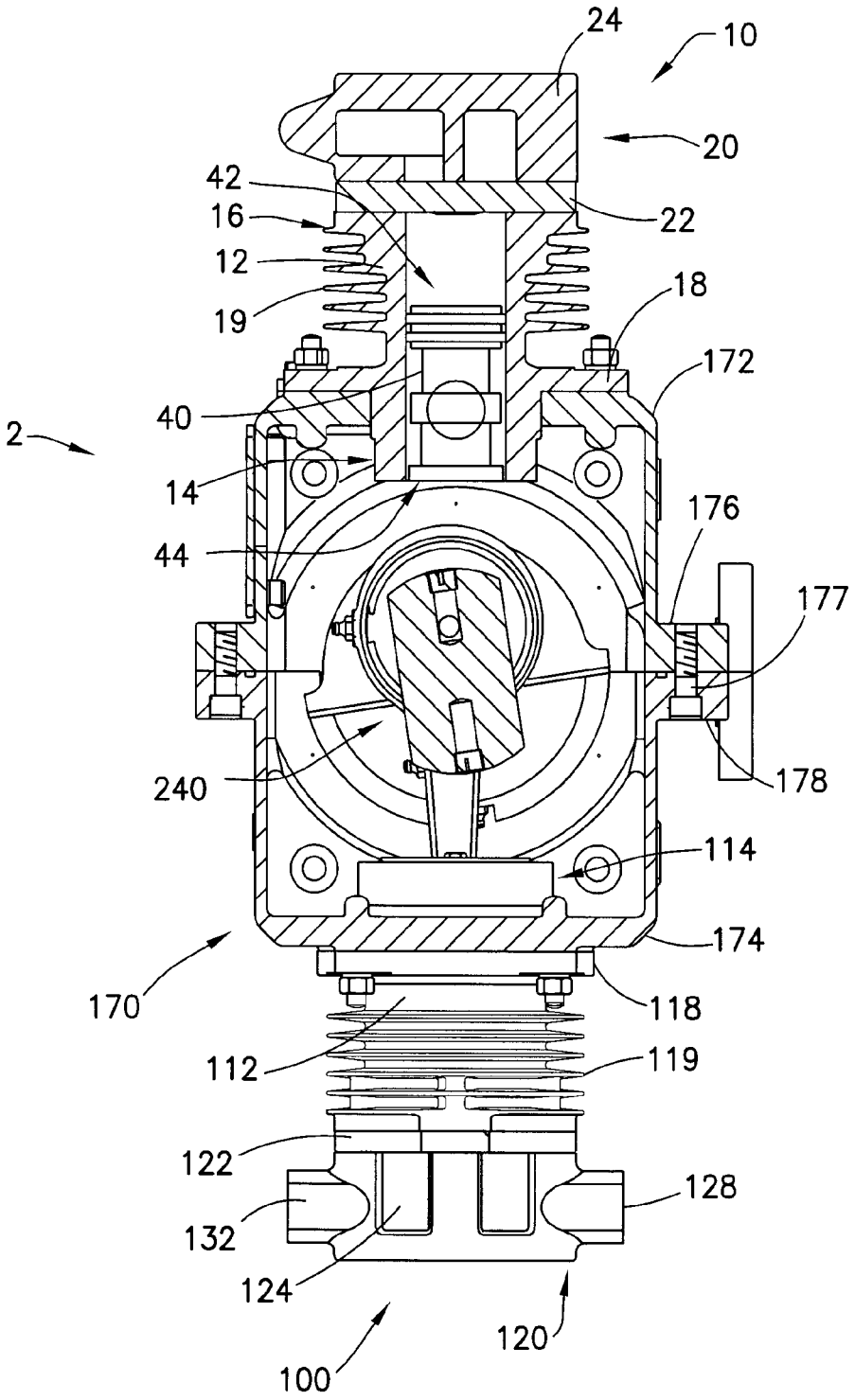
FIG. 5 is a cross-sectional view taken along lines 5-5 in FIG. 4.
Figure 6:
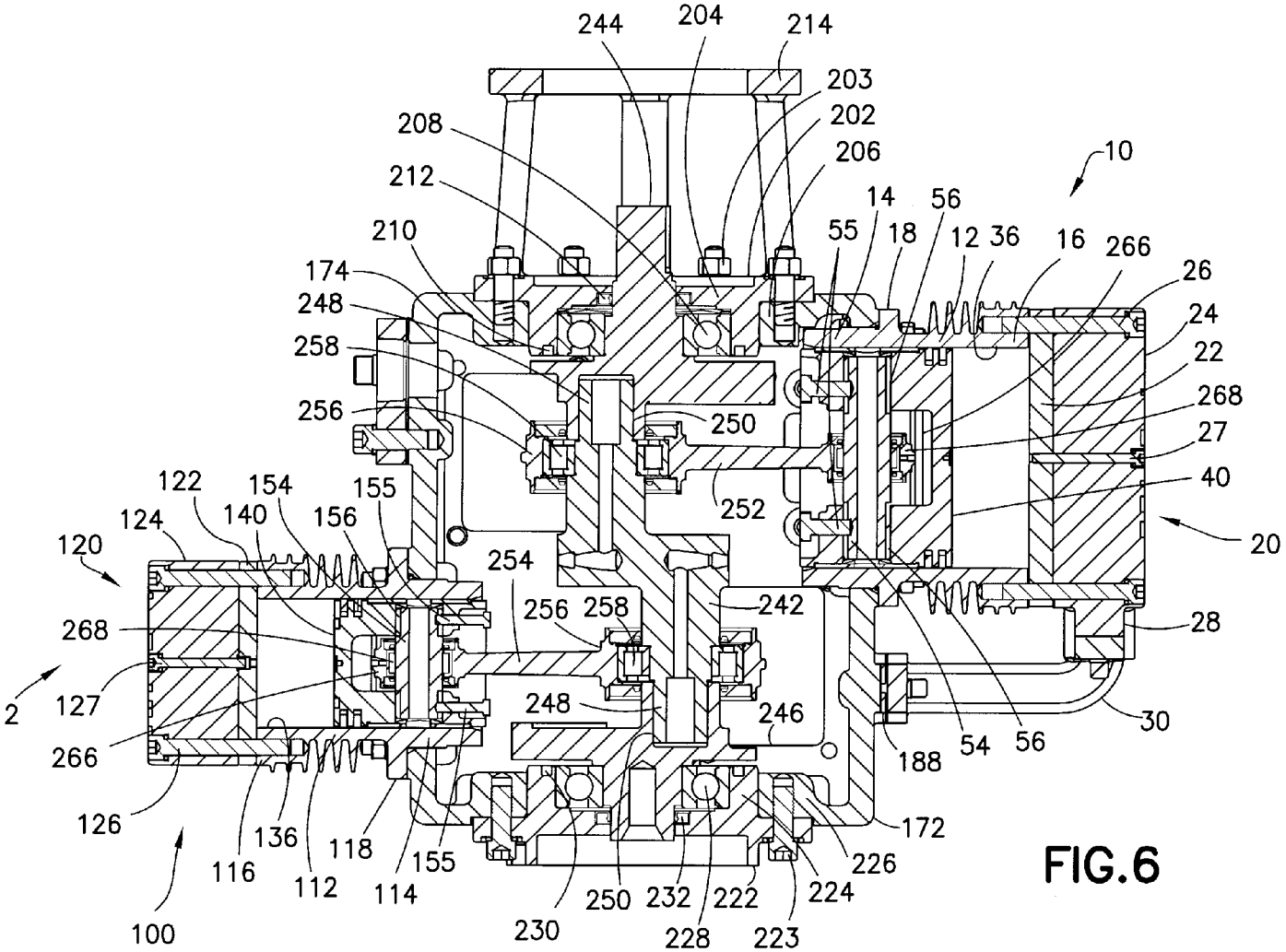
FIG. 6 is a longitudinal cross-sectional view of the oil-free air compressor shown in FIG. 1.

As shown in cross-section in FIG. 5, the first and second piston cylinders 10, 100 are of substantially identical construction with the first piston cylinder 10 operating as the first cylinder and the second piston cylinder 100 operating as the second cylinder in the multi-cylinder air compressor 2. The first piston cylinder 10 is generally larger than the second piston cylinder 100 and has an overall larger diameter than the second piston cylinder 100. The first piston cylinder 10 comprises a cylindrical housing 12 that has a first end 14 adapted to be inserted into a corresponding opening, as described herein, in the compressor housing 170, and a second end 16. The cylindrical housing 12 is formed with a flange 18 located proximal of the first end 14 for interfacing with the exterior of the compressor housing 170. Heat-dissipating fins 19 may be provided about the cylindrical housing 12, and the cylindrical housing 12 may be formed of any suitable material providing sufficient strength and heat-dissipating characteristics such as aluminum.

A cylinder head 20 is secured to the second end 16 of the cylindrical housing 12. The cylinder head 20 generally comprises a valve plate 22 and an air connecting unit 24, with the air connecting unit 24 securing the valve plate 22 on the second end 16 of the cylindrical housing 12 via mechanical fasteners 26. An additional mechanical fastener 27 secures the valve plate 22 to the air connecting unit 24. The air connecting unit 24 comprises an air inlet port 28. An air intake line 30 extends from the air inlet port 28 and is connected to the compressor housing 170 as described herein. The air connecting unit 24 further comprises an air outlet port 32. An air connecting line 34 extends from the air outlet port 32 to fluidly couple, either directly or indirectly, to an air inlet port provided on the second piston cylinder 100 as described herein. Additionally, the valve plate 22 comprises a conventional reed valve assembly (not shown) for permitting airflow into the cylindrical housing 12 via the air intake line 30 and the air inlet port 28 and to be expelled from the cylindrical housing 12 via the air outlet port 32 and the air connecting line 34, to provide pressurized air to the second piston cylinder 100. The air connecting unit 24, the air intake line 30, and the air connecting line 34 may be formed of any suitable material providing sufficient strength and heat transfer characteristics such as aluminum. The cylindrical housing 12 defines an interior surface 36.

Figure 7:
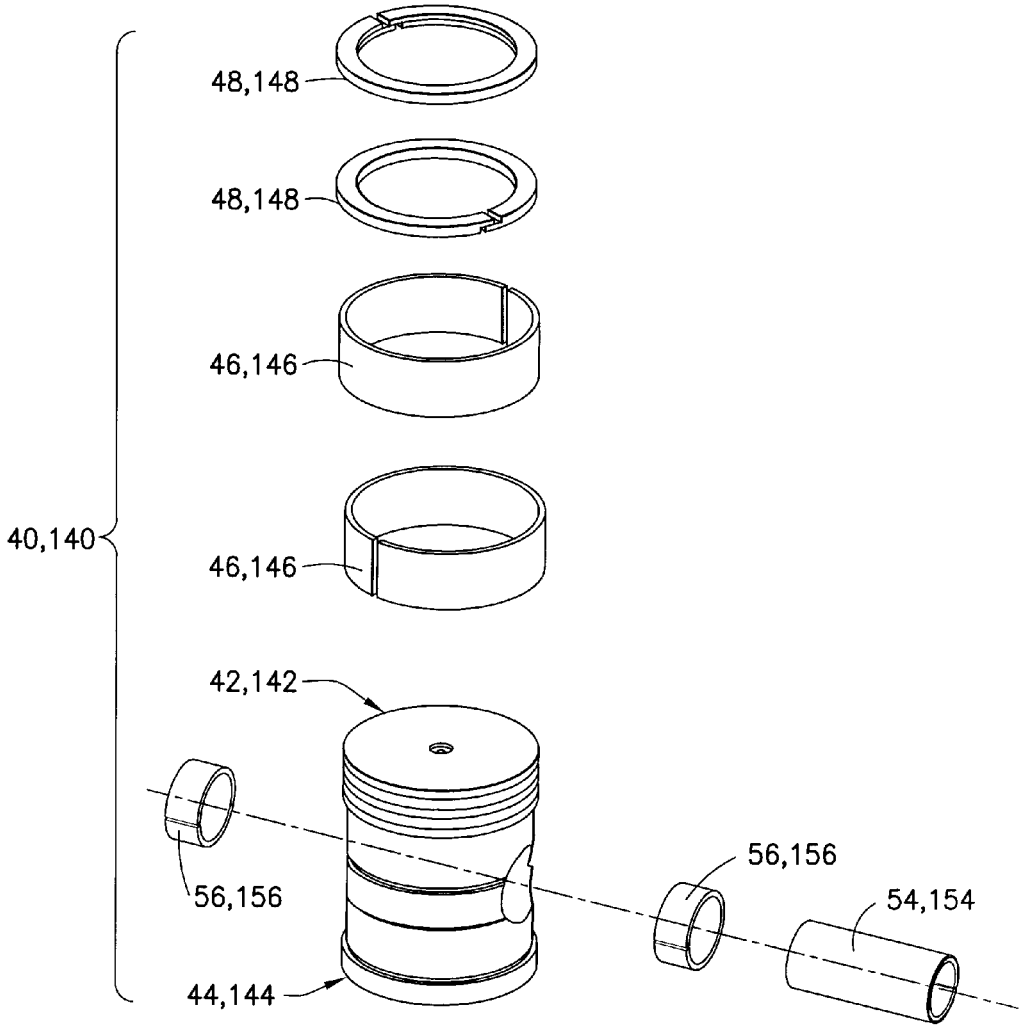
FIG. 7 is an exploded perspective and isolation view of a piston of the oil-free air compressor shown in FIG. 1.
Figure 8:
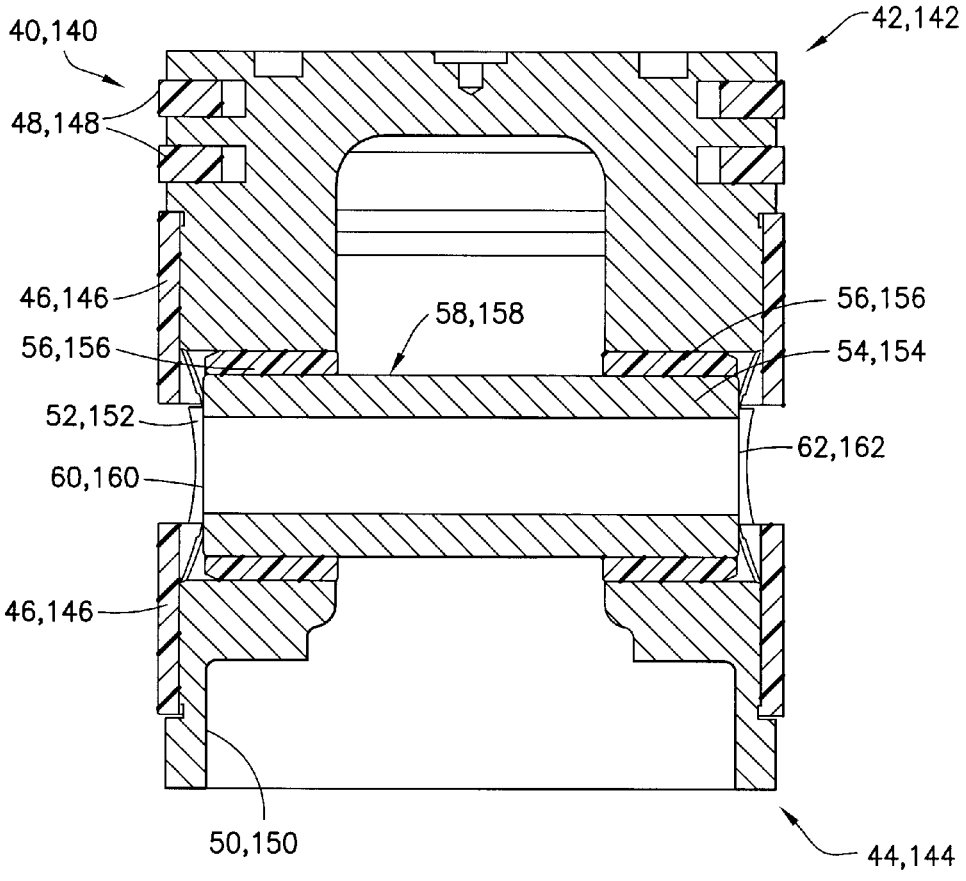
FIG. 8 is a cross-sectional view of an assembled piston of the oil-free air compressor shown in FIG. 1.

Referring additionally to FIGS. 7-8, the first piston cylinder 10 further comprises a piston 40 that is reciprocally operable within the cylindrical housing 12. The piston 40 comprises a first end 42 and a second end 44, and is made of any suitable material providing sufficient strength and heat transfer characteristics such as aluminum. One or more wear bands or rings 46 is provided about the body of the piston 40 proximal of the first end 42 of the piston 40. The wear bands or rings 46 are desirably non-metallic to interface with the interior surface 36 of the cylindrical housing 12 and may be made of a Torlon® polyamide-imide. A pair of piston rings 48 is provided about the first end 42 of the piston 40 and which also interfaces with the interior surface 36 of the cylindrical housing 12. The piston rings 48 are desirably also of non-metallic construction, such as Teflon® (e.g., PTFE), to form a generally fluid-tight seal with the interior surface 36 of the cylindrical housing 12. The body of the piston 40 defines an axial cavity or recess 50 and a transverse cavity or bore 52, which is generally orthogonal to the axial cavity or recess 50. The transverse bore 52 supports a wrist pin 54 that extends transversely through the body of the piston 40. The wrist pin 54 may be a solid wrist pin or, as illustrated, a cylindrical-shaped wrist pin 54. The wrist pin 54 is held in place within the transverse bore 52 by mechanical fasteners 55 that extend into second end 44 of the piston 40 to engage the wrist pin 54. The wrist pin 54 is provided to interface or link with a connecting rod associated with the crankshaft assembly 240, as described further herein. The wrist pin 54 may be made of any suitable material providing sufficient strength and heat transfer characteristics such as aluminum.

Known wrist pin assemblies are generally solid shaft wrist pins where a needle bearing is fitted. These wrist pins are precision-ground and act as an inner race for the needle bearing. These wrist pins must have a cross-sectional area large enough to withstand bending stresses at their centers, and their surfaces must be hard enough to withstand the loading of the needle rollers of the bearing. The needle bearing requires high temperature grease and high temperature seals to contain the grease in a bearing cavity. These prior art wrist pins can slide within the needle bearing and, therefore, the ends of the wrist pins must be fastened to the piston with fasteners, and shock absorbing non-metallic bushings that are located between the wrist pin ends and the piston wrist pin bore.

The wrist pin 54, described previously, is supported in the transverse bore 52 by an oil-free assembly that is comprised by a pair of dry lubricant bushings 56 that are press-fitted into the transverse bore 52. The dry lubricant bushings 56 typically comprise a metal case with a polymer liner. Dry bushings are usually plain composite bushes that are able to run with marginal or no lubrication and have a low coefficient of friction. Dry bushings can include polymer dry bushings and alloy bushings. This oil-free assembly allows the transmission of compression and suction forces from a center portion 58 of the wrist pin 54 to the opposing ends 60, 62 of the wrist pin 54, thus reducing the bending moment of the wrist pin 54 and allowing the wrist pin 54 to have a uniform cross-section of homogeneous material with no additional components thereby reducing weight. The dry lubricant bushings 56 also provide bearing support transmitted directly through the piston 40 instead of the load being transmitted directly through the connecting rod associated with the crankshaft assembly 240, as described further herein. Consequently, the load due to compression is supported by greater bearing area and greater bearing capacity. In addition, the dry lubricant bushings 56 self-lubricate as the dry lubricant bushings 56 are coated with PEEK material or comprise a PEEK liner. In operation, the self-lubricating, dry lubricant bushings 56 lubricate the sliding joint made between the dry lubricant bushings 56 and the wrist pin 54. The dry lubricant bushings 56 and the wrist pin 54 described previously eliminate the need for a "thick" wrist pin as required in the prior art because compression loading shifts from the center portion 58 of the wrist pin 54 to the two ends 60, 62 of the wrist pin 54. Since the wrist pin 54 does not have to withstand bending stresses at its center portion 58, the surface of the wrist pin 54 need not be hard enough to withstand the loading of a needle bearing, as described herein in connection with the crankshaft assembly 240. Additionally, there is no requirement for high temperature grease and high temperature seals to contain the grease in a bearing cavity. Further, the wrist pin cannot slide within the needle bearing since the wrist pin 54 is press-fitted in the hoop of the connecting rod. Therefore, the ends 60, 62 of the wrist pin 54 can be free to float without any fasteners. The shock absorbing non-metallic bushings required in the prior art wrist pins discussed previously are also eliminated. These characteristics are also present in the wrist pin discussed herein in connection with the second piston cylinder 100.

In operation, the piston 40 operates in a reciprocating movement which is generated via the crankshaft assembly 240. Air within the compressor housing 170 is drawn into the cylinder housing 12 via the air intake line 30 and the air inlet port 28 as a result of the downward movement of the piston 40 and is compressed during the upward movement of the piston 40. The reed valve associated with the valve plate 22 has a portion that is opened during the downward movement of the piston 40, drawing air into the cylinder housing 12 from the air intake line 30 and the air inlet port 28, and closes during the upward movement. Further, the reed valve (not shown) has another portion that closes during the downward movement of the piston 40 and opens in the upward movement of the piston 40 whereby the air in the cylinder housing 12 is compressed and is guided out of the cylinder housing 12 via the air outlet port 32 and the air connecting line 34 and is fed to the air inlet port, discussed herein, associated with the second piston cylinder 100.

As noted previously, the second piston cylinder 100 has substantially identical construction to the first piston cylinder 10, as now described hereinafter. The first piston cylinder 10 is generally larger than the second piston cylinder 100 and has an overall larger diameter than the second piston cylinder 100. The second piston cylinder 100 comprises a cylindrical housing 112 that has a first end 114 adapted to be inserted into a corresponding opening, as described herein, in the compressor housing 170, and a second end 116. The cylindrical housing 112 is formed with a flange 118 located proximal of the first end 114 for interfacing with the exterior of the compressor housing 170. Heat-dissipating fins 119 may be provided about the cylindrical housing 112, and the cylindrical housing 112 may be formed of any suitable material providing sufficient strength and heat-dissipating characteristics such as aluminum.

A cylinder head 120 is secured to the second end 116 of the cylindrical housing 112. The cylinder head 120 generally comprises a valve plate 122 and an air connecting unit 124, with the air connecting unit 124 securing the valve plate 122 on the second end 116 of the cylindrical housing 112 via mechanical fasteners 126. An additional mechanical fastener 127 secures the valve plate 122 to the air connecting unit 124. The air connecting unit 124 comprises an air inlet port 128 which is fluidly connected (directly or indirectly) to the air connecting line 34 that extends from the air outlet port 32 associated with the air connecting unit 24 of the first piston cylinder 10. As shown in FIG. 1, an air manifold 300 may be provided as an intermediary device in the air connecting line 34 that extends from the air outlet port 32 associated with the air connecting unit 24 of the first piston cylinder 10 to the air inlet port 128 on the air connecting unit of the second piston cylinder 100. The air connecting unit 124 further comprises an air outlet port 132 which is connected via an air connecting line 134 to a downstream requirement or apparatus, such as an outlet air manifold 302. Additionally, the valve plate 122 comprises a conventional reed valve assembly (not shown) for permitting airflow into the cylindrical housing 112 via the air connecting line 34 and the air inlet port 128 and to be expelled from the cylindrical housing 112 via the air outlet port 132 and the air connecting line 134, to provide pressurized air via the air connecting line 134 to a downstream requirement, such as the outlet air manifold 302. The air connecting unit 124 and the air connecting line 134 may be formed of any suitable material providing sufficient strength and heat transfer characteristics such as aluminum. The cylindrical housing 112 defines an interior surface 136.

With continued reference to FIGS. 1-8, the second piston cylinder 100 also comprises a piston 140 that is reciprocally operable within the cylindrical housing 112. The piston 140 comprises a first end 142 and a second end 144. One or more wear bands or rings 146 are provided about the body of the piston 140 proximal of the first end 142 of the piston 140. The wear bands or rings 146 are desirably non-metallic to interface with the interior surface 136 of the cylindrical housing 112, and may be made of a Torlon® polyamide-imide. A pair of piston rings 148 is provided about the first end 142 of the piston 140 and which also interfaces with the interior surface 136 of the cylindrical housing 112. The piston rings 148 are desirably of non-metallic construction, such as Teflon® (e.g., PTFE), to form a generally fluid-tight seal with the interior surface 136 of the cylindrical housing 112. The body of the piston 140 defines an axial cavity or recess 150 and a transverse cavity or bore 152, which is generally orthogonal to the axial cavity or recess 150. The transverse bore 152 supports a wrist pin 154 that extends transversely through the body of the piston 140. The wrist pin 154 may be a solid wrist pin or, as illustrated, a cylindrical-shaped wrist pin 154. The wrist pin 154 is held in place within the transverse bore 152 by mechanical fasteners 155 that extend into second end 144 of the piston 140 to engage the wrist pin 154. The wrist pin 154 is provided to interface or link with a connecting rod associated with the crankshaft assembly 240, as described further herein. The wrist pin 154 may be made of any suitable material providing sufficient strength and heat transfer characteristics such as aluminum.

In a similar manner to the wrist pin 54, the wrist pin 154 is also supported within the transverse bore 152 by an oil-free assembly that is comprised of a pair of dry lubricant bushings 156 which are press-fitted in the transverse bore 152. The dry lubricant bushings 156 typically comprise a metal case with polymer liner. This oil-free assembly allows the transmission of compression and suction forces from a center portion 158 of the wrist pin 154 to the ends 160, 162 of the wrist pin 154 thus reducing the bending moment of the wrist pin 154 and allowing the wrist pin 154 to have a uniform cross-section of homogeneous material with no additional components thereby reducing weight. The dry lubricant bushings 156 also provide bearing support transmitted directly through the piston 140 instead of the load being transmitted directly through the connecting rod. Consequently, the load, due to compression, is supported by greater bearing area and greater bearing capacity. In addition, the dry lubricant bushings 156 self-lubricate as the dry lubricant bushings 156 are coated with PEEK material or include a PEEK liner. In operation, the self-lubricating, dry lubricant bushings 156 lubricate the sliding joint made between the dry lubricant bushings 156 and the wrist pin 154. The various advantages described previously with respect to the wrist pin 54 are likewise applicable to the wrist pin 154.

In operation, the piston 140 operates in a reciprocating movement which is generated via the crankshaft assembly 240. Air is drawn into the cylinder housing 112 via the air connecting line 130 and the air inlet port 128 as a result of the downward movement of the piston 140 and is compressed during the upward movement of the piston 140. The reed valve assembly (not shown) associated with the valve plate 122 has a portion that is opened during the downward movement of the piston 140, drawing air into the cylinder housing 112 from the air connecting line 130 and the air inlet port 128 and closes during the upward movement. Further, the reed valve (not shown) includes another portion that is closed during the downward movement of the piston 140 and opens in the upward movement of the piston 140 whereby the air in the cylinder housing 112 is compressed and is guided out of the cylinder housing 112 via the air connecting line 134 and is fed via the air connecting line 134 to a downstream requirement such as the outlet air manifold 302.

Figure 9:
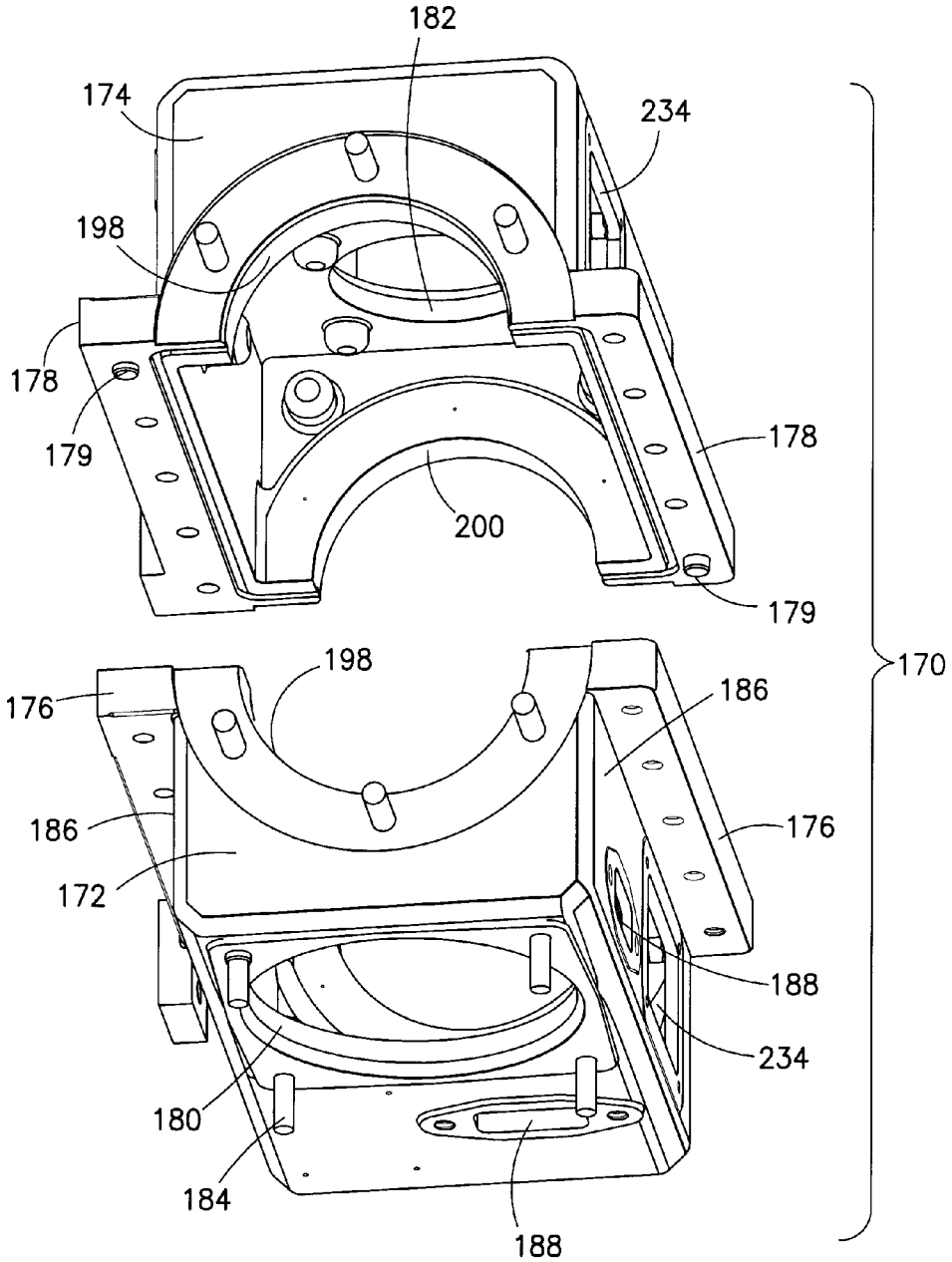
FIG. 9 is an exploded perspective view of a multi-component compressor housing of the oil-free air compressor shown in FIG. 1.

Referring additionally to FIG. 9, the compressor housing or crankcase 170 is desirably a compound structure comprising at least a first housing portion 172 and a second housing portion 174. The first and second housing portions 172, 174 are each generally rectangular shaped structures that are adapted to be joined together to form the overall compressor housing 170. For this purpose, the first and second housing portions 172, 174 have respective lateral flanges 176, 178 that are adapted to be joined together using conventional mechanical fasteners 177, such as bolt and nut combinations. Locating bushings 179 may be provided on the lateral flanges 176, 178 to properly align corresponding openings in the lateral flanges 176, 178 to accept the mechanical fasteners 177. The first housing portion 172 defines an opening 180 sized to accept the first end 14 of the cylindrical housing 12 of the first piston cylinder 10. Similarly, the second housing portion 174 defines an opening 182 sized to accept the first end 114 of the cylindrical housing 112 of the second piston cylinder 100. Mounting elements 184 may be welded or otherwise secured at locations about the respective openings 180, 182. The mounting elements 184 may be mounting pegs or bolts that are adapted to engage openings (not shown) in the respective flanges 18, 118 on the cylindrical housings 12, 112 of the first and second piston cylinders 10, 100 to secure the piston cylinders 10, 100 in place within the openings 180, 182 with conventional nuts or like fastening components.

Figure 2:
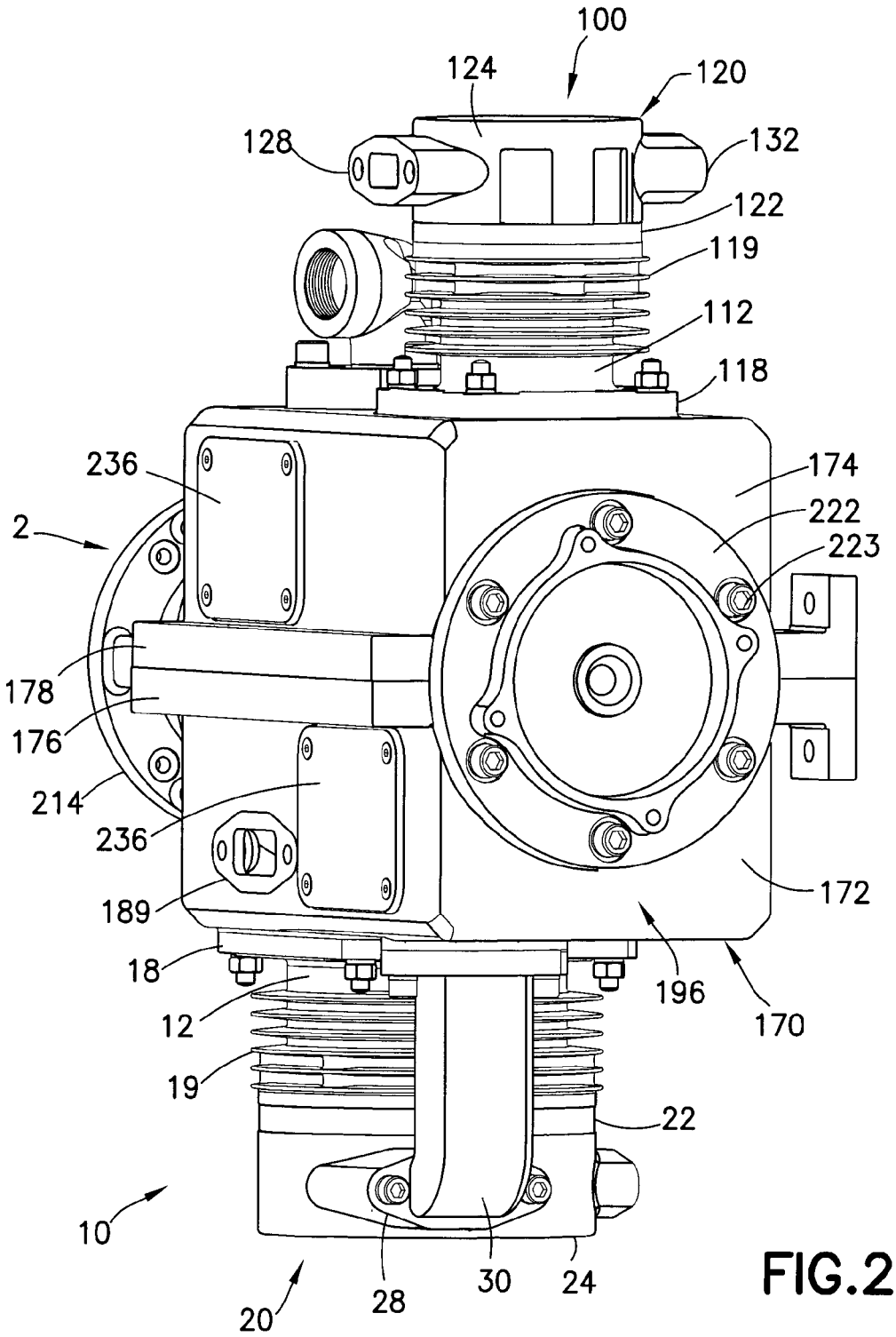
FIG. 2 is a first perspective and isolation view of the oil-free air compressor shown in FIG. 1.
Figure 3:
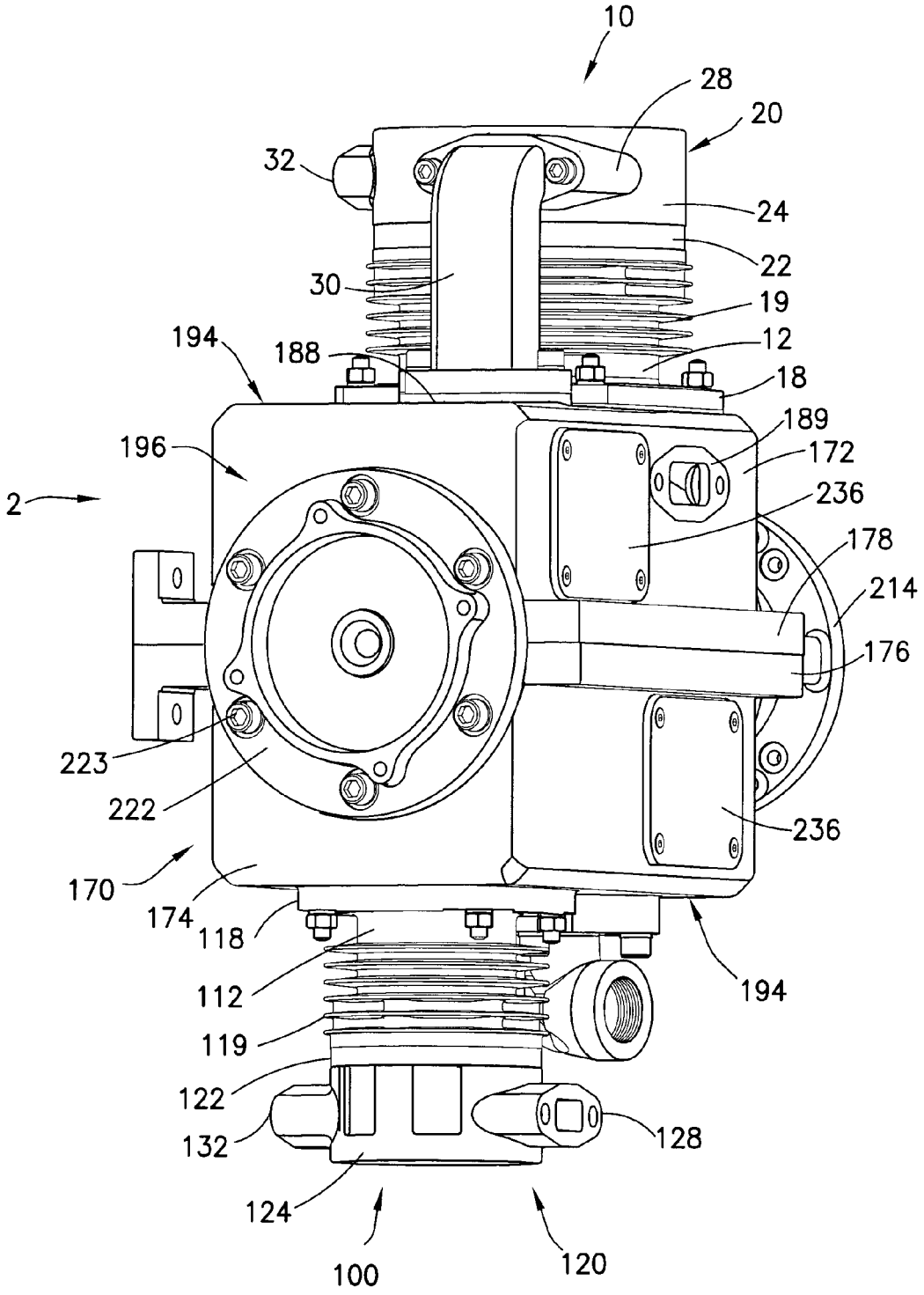
FIG. 3 is a second perspective and isolation view of the oil-free air compressor shown in FIG. 1.
Figure 4:
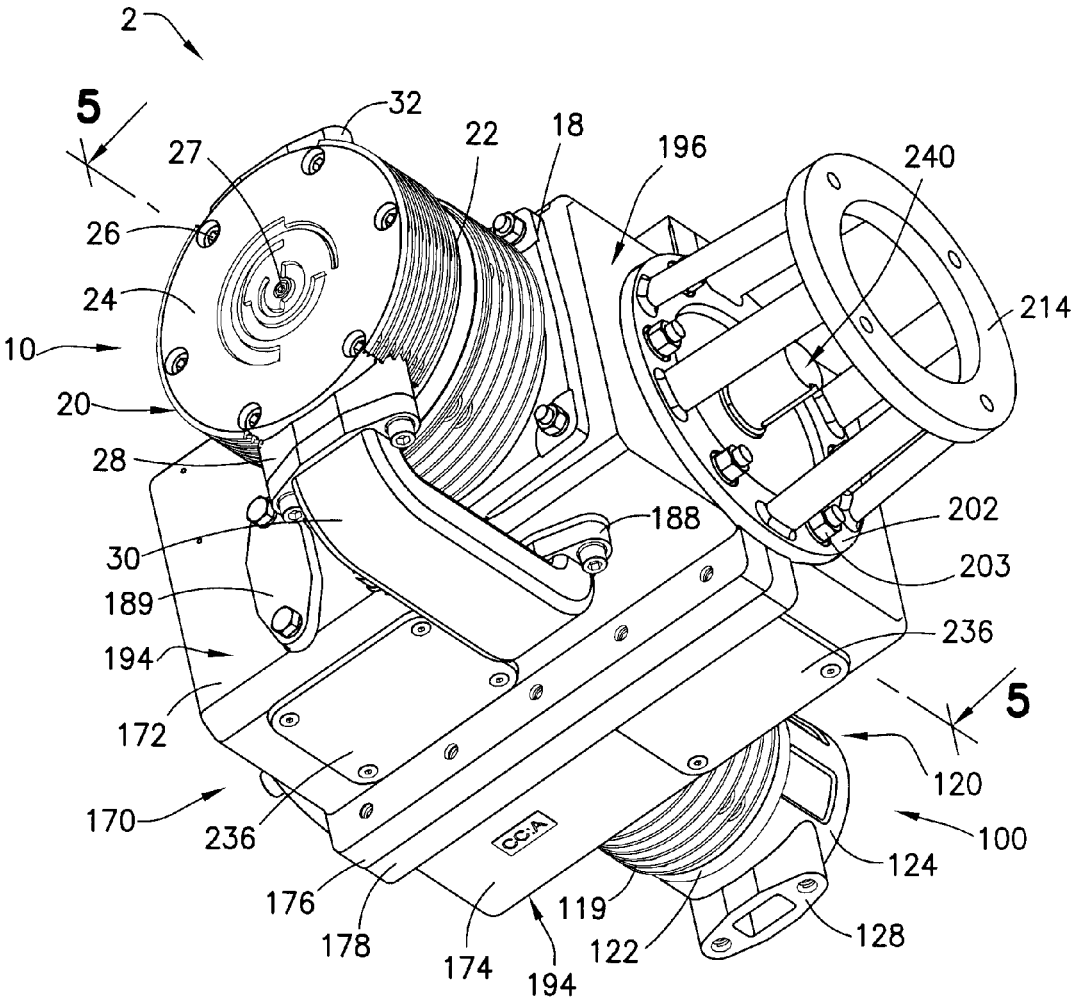
FIG. 4 is a third perspective and isolation view of the oil-free air compressor shown in FIG. 1.

As shown in FIG. 4, the first housing portion 172 further comprises opposing lateral walls 186. The air intake line 30 is placed in fluid communication with an air intake port or opening 188 and may be defined in the first housing portion 172 in one of the opposing lateral walls 186 and is secured via mechanical fasteners to the lateral wall 186 of the first housing portion 172 to place the first piston cylinder 10 in fluid communication with the interior of the compressor housing 170. As an alternative, the air intake port or opening 188 may be provided in the same wall of the first housing portion 170 supporting the first piston cylinder 10 and this modification is also shown in FIGS. 2-3 and in cross-section in FIG. 6. FIG. 9 shows both locations for air intake port 188, and when not in use, the unused air intake port 188 is covered by a cover plate 189. The second housing portion 174 further includes an air intake port 190 for providing air intake generally to the interior of the assembled compressor housing 170. The air intake port 190 may be adapted to interface or connect to an air inlet line 192 connected to a filtering apparatus 304 for filtering air entering the compressor housing 170, as shown in FIG. 1.

The first housing portion 172 and second housing portion 174, when assembled as described previously, form the compressor housing 170. When the first piston cylinder 10 and second piston cylinder 100 are secured in the respective openings 180, 182 in the first housing portion 172 and second housing portion 174, the respective first and second piston cylinders 10, 100 extend outward from opposing longitudinal walls 194 of the compressor housing 170. Two end walls 196 of the compressor housing 170 are defined by assembly of the first and second housing portions 172, 174 and these end walls 196 define respective axial openings 198, 200 in the compressor housing 170.

In summary, the compressor housing 170 as depicted is made up of at least two separate "halves" in the form of housing portions 172, 174 that are assembled together and machined as one. The two halves are located with respect to each other by the locating bushings 179 and held together by mechanical fasteners 177. Benefits of the split compressor housing 170 relate to manufacturing and assembly costs, for example. Because the compressor housing 170 is in at least two major parts, the tooling required to cast the compressor housing 170 may be smaller and, as a result, more foundries are capable of manufacturing this component. This manufacturing advantage can lead to cost savings over a large one-piece housing that requires large tooling and equipment to cast. As known in the art, a one-piece compressor crankcase must be large because the crankshaft has to be assembled before it is placed into the crankcase, and an opening must be provided in the crankcase that is large enough to allow the assembled crankshaft to pass therethrough. Installing an assembled crankshaft through an opening in a one-piece crankcase that is just large enough to accommodate the crankshaft is time consuming and difficult. Typically, the crankshaft has to be carefully threaded into the crankcase while continually repositioning the connecting rods to avoid contact with the inside of the crankcase. A single piece crankshaft can weigh over 80 pounds and maneuvering it is very difficult. The presently disclosed compressor housing 170 allows the crankshaft assembly 240 to be assembled and held stationary while the at least two housing portions 172, 174 are placed on either side of the crankshaft assembly 240 and secured. This assembly step eliminates the need to manipulate a heavy crankshaft as in the prior art. By providing a compound compressor housing 170, overall, the compressor housing 170 may be made smaller, lighter, easier to cast and machine, and easier to assemble. The first and second housing portions 172, 174 forming the compressor housing 170 may be formed of any suitable material providing sufficient strength and heat-dissipating characteristics such as aluminum.

The first axial opening 198 in the compressor housing 170 supports a first crankshaft mounting element 202, which generally encloses the first axial opening 198 and is supported to the end wall 196 of the compressor housing 170 via mechanical fasteners 203. The first crankshaft mounting element 202 comprises an annular portion 204 that is seated within a receiving annular portion 206 formed by the assembly of the first housing portion 172 and second housing portion 174. The annular portion 204 of the first crankshaft mounting element 202 supports a first main crankshaft bearing 208 which, in turn, supports one end of the crankshaft assembly 240. The first main crankshaft bearing 208 is sealed in place by a first shaft seal 210 adapted to seat against the crankshaft assembly 240, and a second shaft seal 212 disposed interiorly within the annular portion 204 of the first crankshaft mounting element 202. The first crankshaft mounting element 202 also supports an external mounting cage 214 for mounting the air compressor 2 in association with a drive component such as a drive motor 306.

The second axial opening 200 in the compressor housing 170 supports a second crankshaft mounting element 222, which generally encloses the second axial opening 200 and is supported to the opposing end wall 196 of the compressor housing 170 via mechanical fasteners 223. The second crankshaft mounting element 222 comprises an annular portion 224 that is seated within a receiving annular portion 226 defined by the assembly of the first housing portion 172 and second housing portion 174. The annular portion 224 of the second crankshaft mounting element 222 supports a second main crankshaft bearing 228 which, in turn, supports the other end of the crankshaft assembly 240. The second main crankshaft bearing 228 is sealed in place by a first shaft seal 230 adapted to seat against the crankshaft assembly 240, and a second shaft seal 232 disposed interiorly within the annular portion 224 of the second crankshaft mounting element 222. The respective first and second crankshaft mounting elements 202, 222 support the opposing ends of the crankshaft assembly 240 and enclose the first and second axial openings 198, 200 defined by the assembly of the first and second housing portions 172, 174 which form the compressor housing 170. As shown in FIGS. 1-4 and 9, the first and second housing portions 172, 174 define several additional openings 234 to provide access to the interior of the compressor housing 170 or to provide other points of connection for additional air handling conduits to the compressor housing 170. These additional openings 234 may be covered with additional covers 236 that are secured to the compressor housing 170 via appropriate mechanical fasteners.

Figure 10:
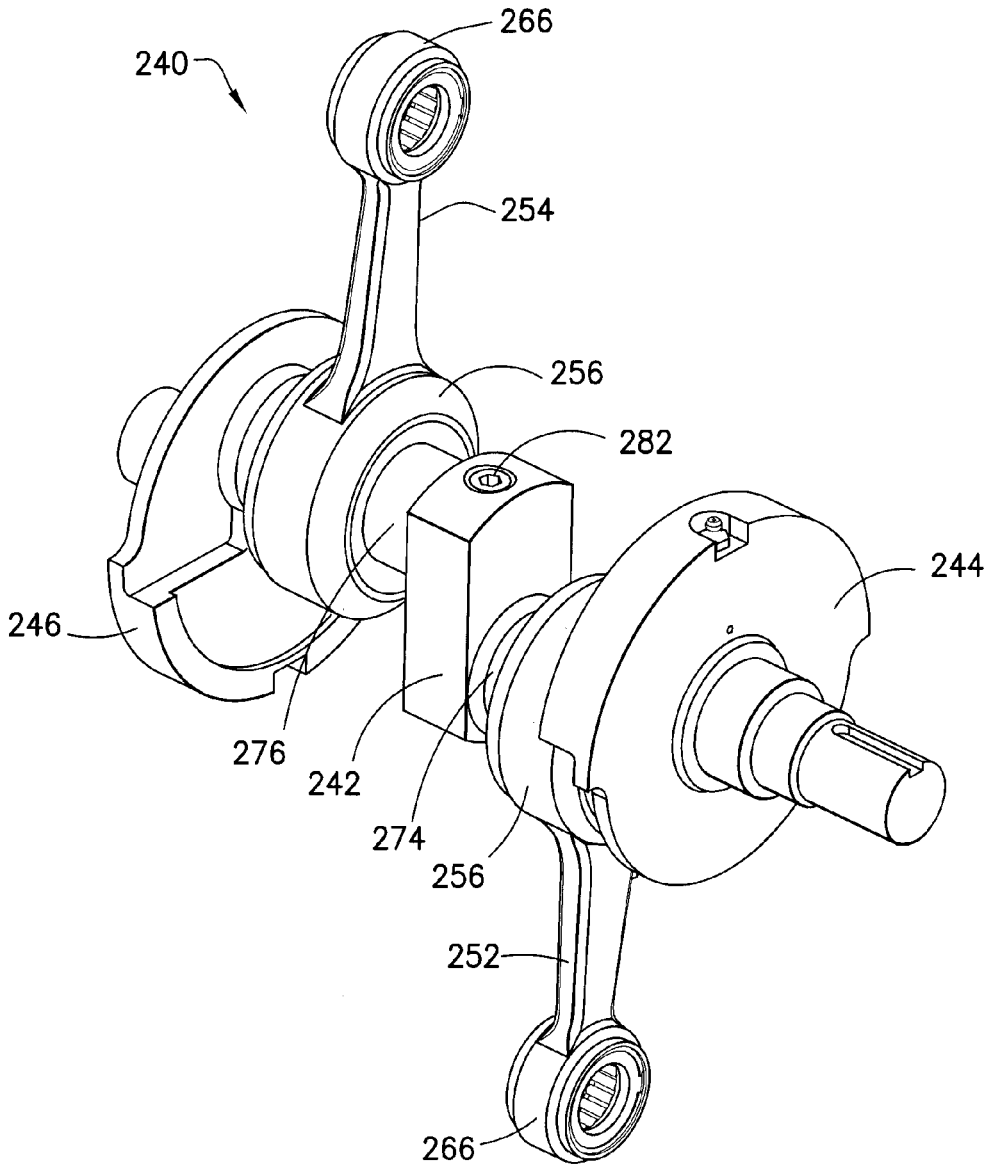
FIG. 10 is a perspective view of a multi-component crankshaft assembly of the oil-free air compressor shown in FIG. 1.
Figure 11:
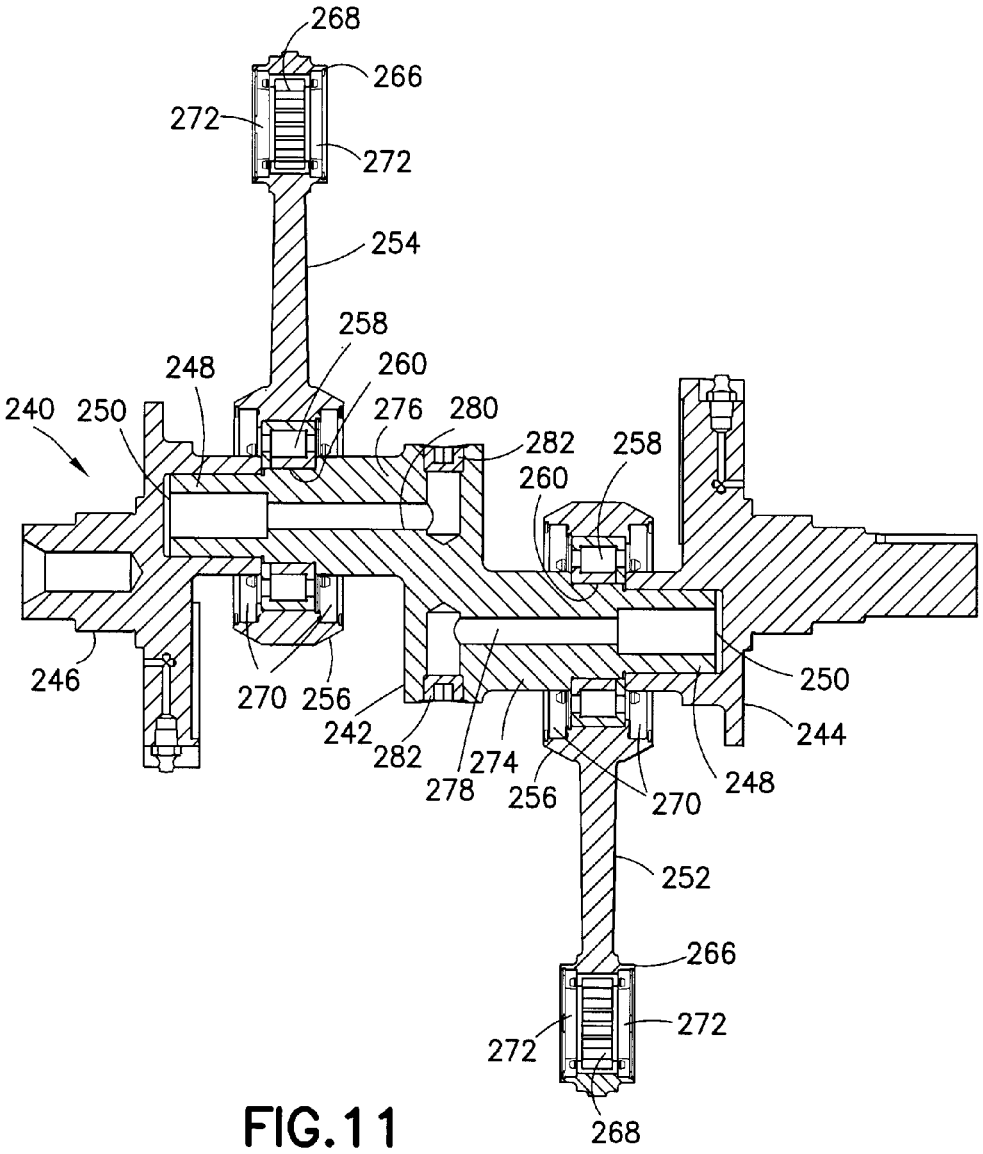
FIG. 11 is a longitudinal cross-sectional view of the multi-component crankshaft assembly of FIG. 10.
Figure 12:
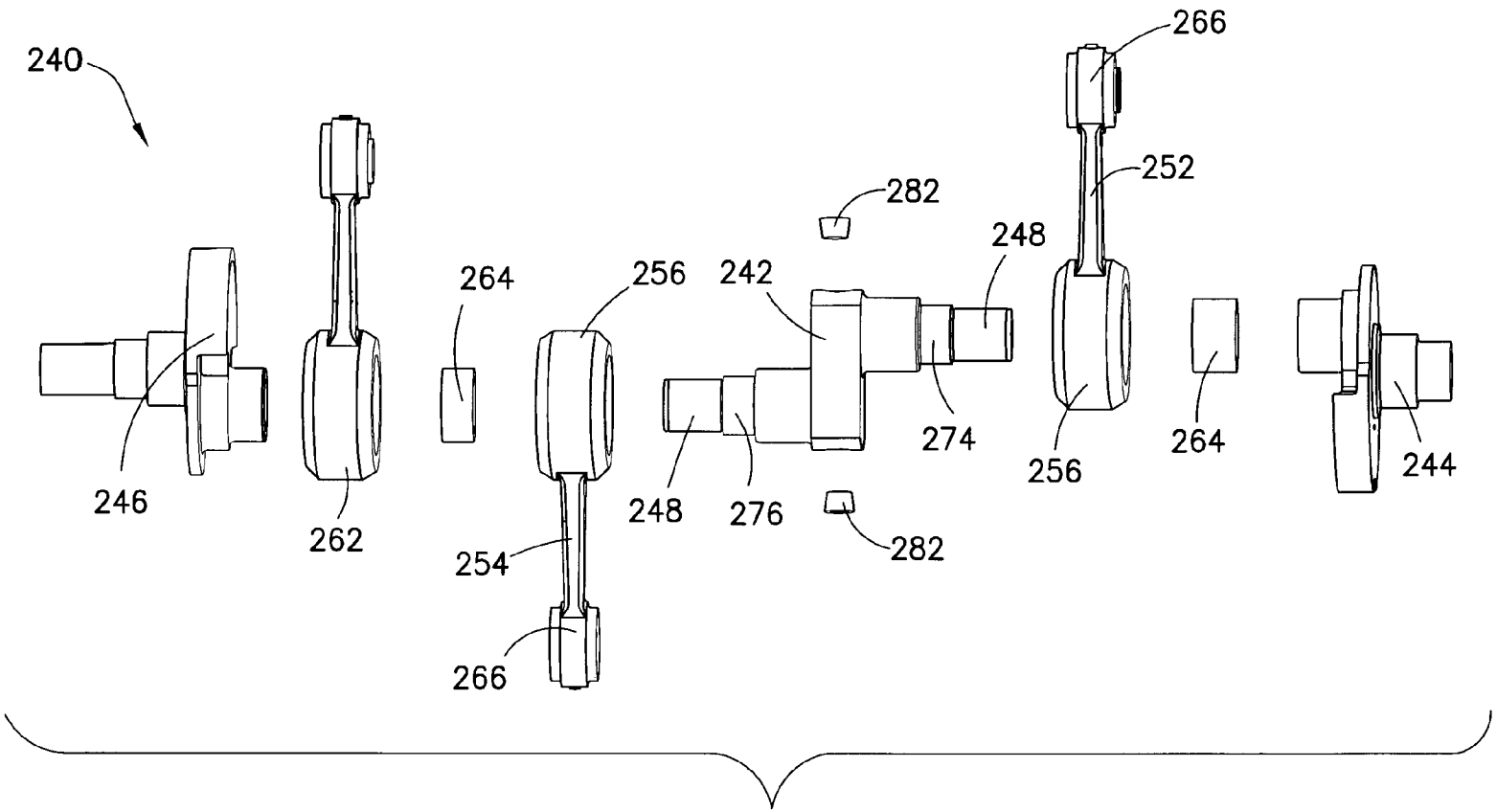
FIG. 12 is an exploded perspective view of another embodiment of the multi-component crankshaft assembly for a three-cylinder embodiment of the oil-free air compressor shown in FIG. 1.

Referring additionally to FIGS. 10-12, the crankshaft assembly 240 is a compound assembly comprised generally by a crankshaft center section 242 and two separately formed crankshaft end sections 244, 246. The first crankshaft end section 244 is supported by the first main crankshaft bearing 208 in the first crankshaft mounting element 202. As described previously, the first crankshaft mounting element 202 supports the external mounting cage 214 for mounting the air compressor 2 in association with a drive component such as the drive motor 306 shown in FIG. 1. Thus, the first crankshaft end section 244 is positioned to interface with a drive motor to impart rotary motion to the crankshaft assembly 240. The opposite crankshaft end section 246 is supported by the second main crankshaft bearing 228 in the second crankshaft mounting element 222 and this end section 246 is positioned to interface with a cooling air fan 308 associated with the air compressor 2. Opposing ends 248 of the crankshaft center section 242 are fixedly secured within respective cavities 250 in the crankshaft end sections 244, 246 by a press-fit connection and like connections.

As shown in FIGS. 10-11, the crankshaft assembly 240 includes at least two connecting rods 252, 254 which link to the pistons 40, 140, respectively, of the first and second piston cylinders 10, 100. The connecting rods 252, 254 each comprise a first circular end flange 256 supported on the crankshaft center section 242 by respective spherical roller bearings 258 that are press-fit into respective circumferential recesses 260 defined adjacent the respective ends 248 of the crankshaft center section 242. The spherical roller bearings 258 are held in place in the recesses 260 by the respective press-fit crankshaft end sections 244, 246. Referring briefly to FIG. 12, while the foregoing discussion relates to an air compressor 2 having two compressing piston-cylinders provided by the first and second piston cylinders 10, 100, additional piston-cylinders may be included in the air compressor 2. FIG. 12 shows that if one or more additional piston cylinders (not shown) are added to the air compressor 2, an additional connecting rod 262 may be mounted on the crankshaft center section 242 adjacent the connecting rod 254 to provide motive forces for operating the additional piston cylinder (not shown). Spacers 264 of predetermined lengths may also be used to mount the respective connecting rods 252, 254, 262 to the crankshaft center section 242 as needed in this embodiment.

The connecting rods 252, 254 each comprise a second circular end flange 266 supported on the respective wrist pins 54, 154 associated with the pistons 40, 140 by respective needle bearings 268. Shaft seals 270 are provided outboard on either side of each of the spherical roller bearings 258 and about the crankshaft center section 242 to seal the spherical roller bearings 258. Likewise, shaft seals 272 are provided outboard on either side of each of the needle bearings 268 and about the respective wrist pins 54, 154 to seal the needle bearings 268. Further, as shown in cross-section in FIG. 11, the crankshaft center section 242 generally comprises an offset construction defined by two opposed shaft portions or arm sections 274, 276 that terminate in ends 248. Respective internal passages 278, 280 are defined in the shaft arm sections 274, 276 that are each sealed with a plug 282. The crankshaft center section 242, end sections 244, 246, and connecting rods 252, 254, 262 may be formed of any suitable material providing sufficient strength such as steel.

The multi-piece crankshaft assembly 240 may be used to replace one-piece crankshafts which are large and heavy. Such single-piece crankshafts are cast or forged by large machinery that requires expensive tooling. Additionally, special machines are needed to machine and balance a one-piece crankshaft. With a one-piece crankshaft, the bearings for the connecting rods have to be sized so that they can be installed on the one-piece crankshaft, often over the bearing seat for the crankshaft main bearings. This means the bearings for the connecting rods have to be larger than necessary, thus adding more weight and bulk. Also, this prior art arrangement requires the addition of bolt-on counterweights which could become loose and cause compressor failure.

The multi-piece crankshaft assembly 240 described hereinabove is made up of a crankshaft center section 242 that is relatively small and can be made from a casting or forging. The two crankshaft end sections 244, 246 also contain counterweights as integral parts and require no fasteners. The foregoing components are small enough to be cast or forged without large equipment. Thus, specialized crankshaft manufacturing equipment is also unnecessary. Since the spherical roller bearings 258 associated with the connecting rods 252, 254, 262 do not have to pass over crankshaft main bearing seats or over crankshaft bends as in a one-piece crankshaft situation, they can be sized based on the loading of the pistons 40, 140 and, as a result, may be smaller.

The crankshaft center section 242 may be designed with the proper throw based on the intended application, including a motor end shaft arm section 274 with the same throw and appropriate end counterweight section 244 and a fan end shaft arm section 276 with the same throw and appropriate end counterweight section 246. The spacers 264 are also used to hold the spherical roller bearings 258 and place them in the proper location in a multi-connecting rod arrangement as shown in FIG. 12. The crankshaft center section 242 is provided to hold the connecting rods 252, 254, 262 by securing the spherical roller bearings 258 in the proper location. As noted previously, for air compressors 2 of more than two piston cylinders, the spacers 264 hold the associated spherical roller bearings 258 in place by pressing onto the inner bearing race for each bearing 258. The crankshaft center section 242 is also provided so that the opposing ends 248 are press-fit into the respective cavities 250 in the crankshaft end sections 244, 246. The two crankshaft end sections 244, 246 contain the crankshaft center section 242 and press onto the inner race of the spherical roller bearings 258, or onto the spacers 264 which press onto the inner races of the spherical roller bearings 258 in a multi-connecting rod arrangement as shown in FIG. 12. The interface between the spherical roller bearings 258 and the crankshaft center section 242 does not have to be a press-fit interface because the crankshaft end sections 244, 246 or the spacers 264 are sufficient to hold the inner races from spinning. To enable easy disassembly of the crankshaft assembly 240 for replacing the connecting rod bearings 268 at overhaul, holes may be drilled into the crankshaft center section 242 to intersect with internal passages 278, 280 and are defined in the shaft arm sections 274, 276 so that a hydraulic pump may be attached to push-off the two crankshaft end sections 244, 246 from the center section 242.

Figure 13:
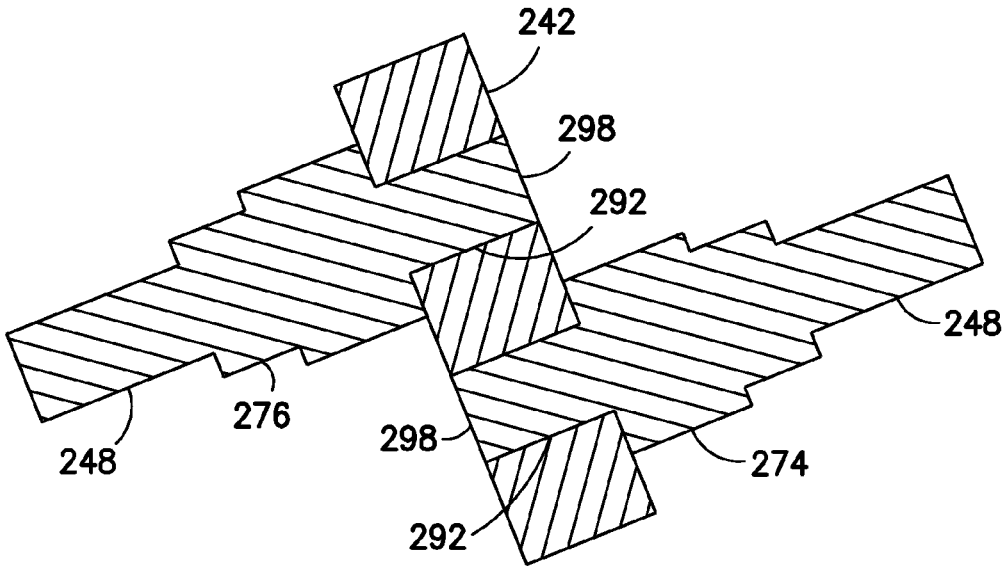
FIG. 13 is a cross-sectional view of the multi-component crankshaft according to another embodiment.

Moreover, as shown in FIG. 13, in another embodiment the crankshaft center section 242 comprises an offset construction defined by two opposed and separate shaft portions or aim sections 274, 276 that terminate in ends 248. Respective internal passages 278, 280, which are not shown FIG. 13 but may be in the form shown in FIG. 11 discussed previously, may be defined in the shaft arm sections 274, 276 and be sealed with respective plugs 282. The crankshaft center section 242 in FIG. 13 defines a pair of through holes 292 to accept mating ends 298 of the respective shaft portions or arm sections 274, 276. The multi-component crankshaft center section 242 may be readily be used in place of the singular or unitary crankshaft center section 242 discussed previously. The multi-component crankshaft center section 242 facilitates easier manufacturing. The mating ends 298 may be secured in the through holes 292 via mechanical fastening or friction fit methods and like methods known in the mechanical arts.

While embodiments of an oil-free air compressor for a rail vehicle are provided in the foregoing description, those skilled in the art may make modifications and alterations to these embodiments without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. An oil-free compressor for a rail vehicle, comprising:

a compressor housing comprising at least a first housing portion and a second housing portion;

a first piston cylinder supported in a first opening in the compressor housing;

a second piston cylinder supported in a second opening in the compressor housing and fluidly connected to the first piston cylinder; and a multi-piece crankshaft assembly supported by the compressor housing and linked to the pistons of the first and second piston cylinders by respective connecting rods, wherein the crankshaft assembly comprises a crankshaft center section comprising two opposing and outward projecting ends and two separately-formed end sections, wherein the connecting rods are mounted for rotation on the crankshaft center section by respective bearings, wherein the center section and the opposing and outward projecting ends are formed as a single unit, and wherein each end section fixedly receives a corresponding opposing and outward projecting end of the crankshaft center section; wherein the opposing and outward projecting ends are placed within a cavity of each end section; wherein the opposing and outward projecting ends each include a horizontal internal passage that are axially offset and placed adjacent to the cavity.

2. An oil-free compressor as claimed in claim 1, wherein the first housing portion and the second housing portion form respective halves of the compressor housing and are secured together with mechanical fasteners.

3. An oil-free compressor as claimed in claim 1, wherein the first piston cylinder is larger than the second piston cylinder.

4. An oil-free compressor as claimed in claim 1, wherein the end sections contain integrally formed counterweights.

5. An oil-free compressor as claimed in claim 1, wherein the opposing and outward projecting ends of the crankshaft center section are secured within respective cavities in the end sections.

6. An oil-free compressor as claimed in claim 1, wherein the crankshaft center section comprises a first arm section offset from a second arm section and each of the arm sections defines a circumferential recess for receiving the bearing associated with the respective connecting rods.

7. An oil-free compressor as claimed in claim 6, wherein the end sections are mounted to the crankshaft center section to secure the bearings associated with the respective connecting rods.

8. An oil-free compressor as claimed in claim 1, wherein one of the two end sections interfaces with a drive motor.

9. An oil-free compressor as claimed in claim 1, wherein each of the two end sections is supported by respective bearings.

10. An oil-free compressor for a rail vehicle, comprising:

a multi-piece compressor housing;

a first piston cylinder supported in a first opening in the compressor housing;

a second piston cylinder supported in a second opening in the compressor housing and fluidly connected to the first piston cylinder; and a multi-piece crankshaft assembly supported by the compressor housing and linked to pistons of the first and second piston cylinders by respective connecting rods, wherein the connecting rods connect to a wrist pin associated with each of the pistons, and the wrist pins are respectively supported by a dry lubricant bushing to the associated piston, and wherein the crankshaft assembly comprises a crankshaft center section comprising two opposing and outward projecting ends and two separately-formed end sections, wherein the connecting rods are mounted for rotation on the crankshaft center section by respective bearings, wherein the center section and the opposing and outward projecting ends are formed as a single unit, and wherein each end section fixedly receives a corresponding opposing and outward projecting end of the crankshaft center section; wherein the opposing and outward projecting ends are placed within a cavity of each end section; wherein the opposing and outward projecting ends each include a horizontal internal passage that are axially offset and placed adjacent to the cavity.

11. An oil-free compressor as claimed in claim 10, wherein the compressor housing comprises at least a first housing portion and a second housing portion.

12. An oil-free compressor as claimed in claim 11, wherein the first housing portion and the second housing portion form respective halves of the compressor housing and are secured together with mechanical fasteners.

13. An oil-free compressor as claimed in claim 10, wherein the first piston cylinder is larger than the second piston cylinder.

14. An oil-free compressor as claimed in claim 10, wherein the end sections contain integrally formed counterweights.

15. An oil-free compressor as claimed in claim 10, wherein the opposing and outward projecting ends of the crankshaft center section are secured within respective cavities in the end sections.

16. An oil-free compressor as claimed in claim 10, wherein the crankshaft center section comprises a first arm section offset from a second arm section and each of the arm sections defines a circumferential recess for receiving the bearing associated with the respective connecting rods.

17. An oil-free compressor as claimed in claim 16, wherein the end sections are mounted to the crankshaft center section to secure the bearing associated with the respective connecting rods.

18. An oil-free compressor as claimed in claim 10, wherein the dry lubricant bushing comprises a PEEK liner.

19. An oil-free compressor as claimed in claim 10, wherein one of the two end sections interfaces with a drive motor.

20. An oil-free compressor as claimed in claim 10, wherein each of the two end sections is supported by respective bearings.

* * * * *